US011628469B2

(12) United States Patent
Itoh et al.

(10) Patent No.: US 11,628,469 B2
(45) Date of Patent: Apr. 18, 2023

(54) METHOD FOR FORMING MULTILAYER COATING FILM

(71) Applicants: KANSAI PAINT CO., LTD., Hyogo (JP); TOYOTA JIDOSHA KABUSHIKI KAISHA, Aichi-ken (JP)

(72) Inventors: Masayuki Itoh, Aichi (JP); Nobuyoshi Suzuki, Aichi (JP); Takuya Nakabayashi, Aichi (JP); Masahiro Omura, Aichi (JP); Takao Tsukimori, Aichi-ken (JP)

(73) Assignees: KANSAI PAINT CO., LTD., Hyogo (JP); TOYOTA JIDOSHA KABUSHIKI KAISHA, Aichi-Ken (JP)

( * ) Notice: Subject to any disclaimer, the term of this patent is extended or adjusted under 35 U.S.C. 154(b) by 0 days.

(21) Appl. No.: 17/500,405

(22) Filed: Oct. 13, 2021

(65) Prior Publication Data

US 2022/0111415 A1 Apr. 14, 2022

(30) Foreign Application Priority Data

Oct. 14, 2020 (JP) ..... JP2020-173030

(51) Int. Cl.
*B05D 7/00* (2006.01)
*B05D 5/06* (2006.01)
*B05D 1/02* (2006.01)

(52) U.S. Cl.
CPC ..... *B05D 7/576* (2013.01); *B05D 1/02* (2013.01); *B05D 5/068* (2013.01)

(58) Field of Classification Search
CPC ..... B05D 7/572; B05D 7/576; B05D 7/14
See application file for complete search history.

(56) References Cited

U.S. PATENT DOCUMENTS 8,720,797 B2 * 5/2014 Yamasaki ..... B05B 3/1014 239/222
2009/0226728 A1 * 9/2009 Onoe ..... C09D 5/02 524/505
2010/0155504 A1 6/2010 Yamasaki et al.
2015/0218405 A1 * 8/2015 Iwata ..... C08G 18/227 428/423.1
2016/0303588 A1 10/2016 Arichi et al.
2017/0297052 A1 * 10/2017 Shinkoda ..... B05D 7/57
2018/0230326 A1 * 8/2018 Hase ..... C09D 167/02
2019/0344309 A1 11/2019 Ono et al.
2021/0276042 A1 9/2021 Itoh et al.

FOREIGN PATENT DOCUMENTS

| | | |
|---|---|---|
| CN | 103965731 | 8/2014 |
| CN | 106040464 | 10/2016 |
| JP | 63-319087 | 12/1988 |
| JP | 11-226481 | 8/1999 |
| JP | 2008-237939 | 10/2008 |
| JP | 2019-195791 | 11/2019 |
| WO | 2006/056866 | 6/2006 |
| WO | 2018/092874 | 5/2018 |

OTHER PUBLICATIONS

Office Action dated Oct. 31, 2022 in Chinese Patent Application No. 202111195239.5, with English-language translation.

* cited by examiner

*Primary Examiner* — Dah-Wei D. Yuan
*Assistant Examiner* — Kristen A Dagenais
(74) *Attorney, Agent, or Firm* — Wenderoth, Lind & Ponack, L.L.P.

(57) ABSTRACT

The present invention provides a multilayer coating film-forming method that is capable of forming a multilayer coating film with excellent finished appearance and excellent luster. The aqueous base paint (X) is applied by using a rotary-atomization bell-shaped coater under coating conditions of a shaping air pressure of 0.15 to 0.25 MPa and a paint discharge amount of 100 to 300 cm3/min. The viscosity 60 seconds after the application of the aqueous base paint (X), measured at a temperature of 23° C. and a shear rate of 0.1 sec-1, is 90 to 160 Pa·s, the solids content 60 seconds after the application is 20 to 40 mass %, and the film thickness 60 seconds after the application is 17 to 35 μm. The effect pigment dispersion (Y) contains a flake-aluminum pigment (A) with an average thickness of 1 nm or more and less than 70 nm, a flake-aluminum pigment (B) with an average thickness of 70 nm to 250 nm, a hydroxy-containing acrylic resin (C), a rheology control agent (D), a surface-adjusting agent (E), and water, the effect pigment dispersion (Y) having a solids content of 2 to 9 mass %. The effect coating film after curing has a film thickness of 0.5 to 2.0 μm.

2 Claims, No Drawings

METHOD FOR FORMING MULTILAYER COATING FILM

TECHNICAL FIELD

The present invention relates to a method for forming a multilayer coating film.

BACKGROUND ART

In general, coating films formed by applying paint to various substrates are required to not only protect the substrates but also impart design (excellent appearance) to their appearance. In particular, topcoat paint applied to the exterior panels of automobiles is required to be capable of forming a top coating film with excellent texture and sophisticated design.

Coating of automotive bodies is typically performed by sequentially forming, on a substrate, an electrodeposition coating film, an intermediate coating film, and a top coating film. Conventional methods generally comprise immersing a substrate in an electrodeposition paint for electrodeposition coating and curing the paint by baking at a high temperature to form an electrodeposition coating film, applying an intermediate paint to the electrodeposition coating film, followed by baking to form an intermediate coating film, and applying a topcoat paint to the intermediate coating film, followed by baking to form a top coating film.

For example, a multilayer coating film with a metallic coating color, which has been recently commonly used for a top coating film to achieve a high-quality design, is formed by using, as a topcoat paint, an effect base paint that contains an effect pigment for imparting excellent luster and a transparent clear paint. A high-grade effect coating film has excellent luster, and in the coating film, the effect pigment is relatively uniformly present, showing almost no metallic mottling.

The effect pigment for use is typically an aluminum flake pigment with metallic luster. Multilayer coating films with a metallic coating color are typically formed by sequentially applying a base paint, an effect base paint containing an effect pigment, and a clear paint on a baked intermediate coating film using a wet-on-wet process, followed by curing the resulting uncured coating films with a single baking treatment.

For example, Patent Literature (PTL) 1 discloses a method of forming a coating film with metallic luster, the method comprising sequentially applying a first base metallic paint comprising an aluminum pigment (A) having an average particle diameter D50 of 13 to 40 μm and an average thickness of 0.4 to 2.5 μm, and an aluminum pigment (B) having an average particle diameter D50 of 4 to 30 μm and an average thickness of 0.02 to 20 less than 0.4 μm, wherein the mass ratio on a solids content basis of the aluminum pigments (A) and (B) (A/B) is 90/10 to 10/90, and the total mass on a solids content basis of the aluminum pigments (A) and (B) (A+B) is 5 to 50 parts by mass per 100 parts by mass of the resin solids content, a second base effect paint comprising a very small flake pigment or a very small flake pigment and an aluminum pigment (C), and a clear paint, followed by baking to cure the resulting coating films. Based on this method, PTL 1 discloses providing a method of forming a coating film that has excellent undercoat hiding power and excellent brilliance with both pearly and metallic luster, as well as three-dimensional brilliance.

However, in the method disclosed in PTL 1, the coating film formed from the second base effect paint has a relatively large film thickness, and the metallic luster is insufficient.

PTL 2 discloses a method for forming a multilayer coating film by sequentially performing the following steps (1) to (5): (1) applying a colored paint (W) to a substrate, followed by heating, to form a colored coating film, (2) applying a base paint (X) to the colored coating film formed in step (1) to form a base coating film, (3) applying an effect pigment dispersion (Y) to the base coating film formed in step (2) to form an effect coating film, (4) applying a clear paint (Z) to the effect coating film formed in step (3) to form a clear coating film, and (5) heating the uncured base coating film, the uncured effect coating film, and the uncured clear coating film formed in steps (2) to (4) to thereby simultaneously cure these three coating films; wherein the effect pigment dispersion (Y) contains water, a surface adjusting agent (A), a flake-effect pigment (B), and a rheology control agent (C), and has a solids content of 0.5 to 10 mass %. PTL 2 discloses that this method can produce a multilayer coating film with excellent metallic luster.

In the method of PTL 2, excellent metallic luster can be obtained. However, when the base coating film has a non-smooth surface, the effect coating film, which has a small film thickness, reflects the non-smooth surface of the base coating film, possibly resulting in insufficient finished appearance of the resulting multilayer coating film.

In the fields of, in particular, automotive coating etc., the texture and design imparted by the formed coating films have a significant impact on the saleability of the product. It is thus necessary to develop a coating film-forming method that is capable of forming a multilayer coating film with high-quality design in which defects such as sagging and unevenness are removed or reduced.

CITATION LIST

Patent Literature

PTL 1: JP2008-237939A
PTL 2: WO 2018/092874

SUMMARY OF INVENTION

Technical Problem

An object of the present invention is to provide a multilayer coating film-forming method that is capable of forming a multilayer coating film with excellent finished appearance and excellent luster.

Solution to Problem

The present invention encompasses the subject matter described in the following item.

Item 1. A method for forming a multilayer coating film, comprising in sequence:

step (1): applying a solvent-based intermediate paint (V) to a substrate to form an uncured first intermediate coating film; step (2): heating the uncured first intermediate coating film to cure the coating film;

step (3): applying a solvent-based intermediate paint (W) to the cured first intermediate coating film to form an uncured second intermediate coating film;

step (4): heating the uncured second intermediate coating film to cure the coating film;

step (5): applying an aqueous base paint (X) to the cured second intermediate coating film to form an uncured base coating film;

step (6): applying an effect pigment dispersion (Y) to the uncured base coating film to form an uncured effect coating film;

step (7): applying a clear paint (Z) to the uncured effect coating film to form an uncured clear coating film; and step (8): heating the uncured base coating film, the uncured effect coating film, and the uncured clear coating film to simultaneously cure the coating films, wherein the aqueous base paint (X) is applied using a rotary-atomization bell-shaped coater under coating conditions of a shaping air pressure of 0.15 to 0.25 MPa and a paint discharge amount of 100 to 300 $cm^3$/min, the viscosity 60 seconds after the application of the aqueous base paint (X), measured at a temperature of 23° C. and a shear rate of 0.1 sec-1, is 90 to 160 mPa·s, the solids content 60 seconds after the application is 20 to 40 mass %, and the film thickness 60 seconds after the application is 17 to 35 μm, wherein the effect pigment dispersion (Y) contains a flake-aluminum pigment (A) with an average thickness of 1 nm or more and less than 70 nm, a flake-aluminum pigment (B) with an average thickness of 70 nm to 250 nm, a hydroxy-containing acrylic resin (C), a rheology control agent (D), a surface-adjusting agent (E), and water, the effect pigment dispersion (Y) having a solids content of 2 to 9 mass %, and wherein the effect coating film after curing has a film thickness of 0.5 to 2.0 μm.

Advantageous Effects of Invention

The present invention is capable of providing a method for forming a multilayer coating film with excellent finished appearance and excellent luster.

DESCRIPTION OF EMBODIMENTS

The method for forming a multilayer coating film of the present invention is a method for forming a multilayer coating film, comprising in sequence:

step (1): applying a solvent-based intermediate paint (V) to a substrate to form an uncured first intermediate coating film;

step (2): heating the uncured first intermediate coating film to cure the coating film;

step (3): applying a solvent-based intermediate paint (W) to the cured first intermediate coating film to form an uncured second intermediate coating film;

step (4): heating the uncured second intermediate coating film to cure the coating film;

step (5): applying an aqueous base paint (X) to the cured second intermediate coating film to form an uncured base coating film;

step (6): applying an effect pigment dispersion (Y) to the uncured base coating film to form an uncured effect coating film;

step (7): applying a clear paint (Z) to the uncured effect coating film to form an uncured clear coating film; and step (8): heating the uncured base coating film, the uncured effect coating film, and the uncured clear coating film to simultaneously cure the coating films, wherein the aqueous base paint (X) is applied using a rotary-atomization bell-shaped coater under coating conditions of a shaping air pressure of 0.15 to 0.25 MPa and a paint discharge amount of 100 to 300 $cm^3$/min, the viscosity 60 seconds after the application of the aqueous base paint (X), measured at a temperature of 23° C. and a shear rate of 0.1 $sec^{-1}$, is 90 to 160 mPa·s, the solids content 60 seconds after the application is 20 to 40 mass %, and the film thickness 60 seconds after the application is 17 to 35 μm, wherein the effect pigment dispersion (Y) contains a flake-aluminum pigment (A) with an average thickness of 1 nm or more and less than 70 nm, a flake-aluminum pigment (B) with an average thickness of 70 nm to 250 nm, a hydroxy-containing acrylic resin (C), a rheology control agent (D), a surface-adjusting agent (E), and water, the effect pigment dispersion (Y) having a solids content of 2 to 9 mass %, and wherein the effect coating film after curing has a film thickness of 0.5 to 2.0 μm.

Step (1)

In step (1) of the present invention, a solvent-based intermediate paint (V) is applied to a substrate to form an uncured first intermediate coating film.

Substrate

In the present invention, the substrate is not particularly limited. Examples of the substrate include exterior panel parts of automotive bodies such as for passenger cars, trucks, motorcycles, and buses; automotive parts; and exterior panel parts of household electric appliances such as cellular phones and audio equipment. Of these substrates, the exterior panel parts of automotive bodies and automotive parts are preferable.

The material for the substrate is not particularly limited. Examples include metallic materials, such as iron, aluminum, brass, copper, stainless steel, tin plate, galvanized steel, steel plated with a zinc alloy (e.g., Zn—Al, Zn—Ni, and Zn—Fe); plastic materials, such as polyethylene resins, polypropylene resins, acrylonitrile-butadiene-styrene (ABS) resins, polyamide resins, acrylic resins, vinylidene chloride resins, polycarbonate resins, polyurethane resins, epoxy resins, and like resins, and various types of FRP; inorganic materials, such as glass, cement, and concrete; wood; and textile materials (e.g., paper and cloth). Of these materials, metallic materials and plastic materials are preferable.

The substrate may be a metallic material mentioned above or an automotive body etc. formed from a metallic material mentioned above that has been subjected to a surface treatment, such as a phosphoric acid salt treatment, chromate treatment, or composite oxide treatment. The substrate may further have a coating film on the surface-treated surface.

Examples of the substrate having a coating film include those obtained by subjecting a base material to a surface treatment, if necessary, and forming an undercoating film on the surface. In particular, automotive bodies having an undercoating film formed from an electrodeposition paint are preferable, and automotive bodies having an undercoating film formed from a cationic electrodeposition paint are more preferable.

Solvent-Based Intermediate Paint (V)

In this specification, the term "solvent-based intermediate paint (V)" refers to a paint used to obtain surface smoothness of the resulting coating film and to enhance the physical properties of the resulting coating film, such as impact resistance and chipping resistance (tolerance to damage to coating films caused by the collision of obstructions, such as small stones).

The solvent-based intermediate paint (V) for use in this step is preferably a solvent-based paint that is commonly used in this field, and that contains a base resin, a curing agent, and an organic solvent.

The base resin and the curing agent may be known compounds commonly used in this field. Examples of the base resin include acrylic resins, polyester resins, and polyurethane resins. Examples of the curing agent include amino resins, polyisocyanate compounds, and blocked polyisocyanate compounds.

Examples of the organic solvent include hydrocarbons, such as aliphatic hydrocarbons (e.g., hexane and heptane), aromatic hydrocarbons (e.g., xylene and toluene), and alicyclic hydrocarbons; esters, such as ethyl acetate and butyl acetate; ethers, such as ethylene glycol monomethyl ether; alcohols, such as ethanol, propanol, and 2-ethylhexyl alcohol; ketones, such as methyl ethyl ketone and methyl isobutyl ketone; amides; and other solvents. Examples of organic solvents containing aromatic hydrocarbons include Swasol 310 and Swasol 1000 (produced by Cosmo Oil Co., Ltd.).

In addition to the above components, the solvent-based intermediate paint (V) for use in the method of the present invention may appropriately contain an ultraviolet absorber, a defoaming agent, a thickener, a rust inhibitor, a surface-adjusting agent, a pigment, and the like, if desired.

Coating of the solvent-based intermediate paint (V) having the above structure can improve the surface smoothness, impact resistance, and chipping resistance of the coated articles.

The solvent-based intermediate paint (V) can be applied by using general-purpose coating methods commonly used in this field. Examples of the coating method include coating methods using a brush or a coater. Among these, a coating method using a coater is preferable. For example, the coater is preferably an airless spray coater, an air spray coater, or a rotary-atomization electrostatic coater, such as a paint cassette coater, and particularly preferably a rotary-atomization electrostatic coater. The use of the above paint and coating method can form an uncured first intermediate coating film with excellent coating appearance.

Step (2)

In step (2) of the present invention, the uncured first intermediate coating film is heated to cure the coating film.

The uncured first intermediate coating film can be subjected to baking treatment to obtain a cured coating film. The temperature of the baking treatment is typically 80 to 180° C., and particularly preferably 120 to 160° C. The time for the baking treatment is preferably 10 to 60 minutes.

The first intermediate coating film has a film thickness of preferably 10 to 50 μm, and particularly preferably 15 to 40 μm, on a cured coating film basis.

Step (3)

In step (3) of the present invention, a solvent-based intermediate paint (W) is applied to the cured first intermediate coating film to form an uncured second intermediate coating film.

Solvent-Based Intermediate Paint (W)

In this specification, the term "solvent-based intermediate paint (W)" refers to a paint used to obtain surface smoothness of the resulting coating film and to enhance the physical properties of the resulting coating film, such as impact resistance and chipping resistance.

The solvent-based intermediate paint (W) for use in this step is preferably a solvent-based paint that is commonly used in this field, and that contains a base resin, a curing agent, and an organic solvent. The base resin, the curing agent, and the organic solvent may be those described above for the solvent-based intermediate paint (V).

The formulation of the solvent-based intermediate paint (W) may be the same as or different from that of the solvent-based intermediate paint (V).

The solvent-based intermediate paint (W) can be produced by a method similar to the method for producing the solvent-based intermediate paint (V).

Coating of the solvent-based intermediate paint (W) can further improve the surface smoothness, impact resistance, and chipping resistance of the coated articles.

The solvent-based intermediate paint (W) can be applied by using general-purpose coating methods commonly used in this field. Examples of the coating method include coating methods using a brush or a coater. Among these, a coating method using a coater is preferable. For example, the coater is preferably an airless spray coater, an air spray coater, or a rotary-atomization electrostatic coater, such as a paint cassette coater, and particularly preferably a rotary-atomization electrostatic coater. The use of the above paint and coating method can form an uncured second intermediate coating film with excellent coating appearance.

Step (4)

In step (4) of the present invention, the uncured second intermediate coating film is heated to cure the coating film.

The uncured second intermediate coating film can be subjected to baking treatment to obtain a cured coating film. The temperature of the baking treatment is typically 80 to 180° C., and particularly preferably 120 to 160° C. The time for the baking treatment is preferably 10 to 60 minutes.

The second intermediate coating film has a film thickness of preferably 10 to 50 μm, and particularly preferably 15 to 40 μm, on a cured coating film basis.

Step (5)

In step (5) of the present invention, an aqueous base paint (X) is applied to the cured second intermediate coating film to form an uncured base coating film.

Aqueous Base Paint (X)

In this specification, the term "aqueous base paint (X)" refers to an aqueous paint used to impart luster and improve finished appearance by hiding the underlying electrodeposition coating film and intermediate coating film.

For the aqueous base paint (X), an aqueous paint that contains a base resin, a curing agent, and an aqueous medium can be suitably used.

The base resin and the curing agent may be known compounds commonly used in this field. Examples of the base resin include acrylic resins, polyester resins, and polyurethane resins. The base resin preferably contains an acrylic resin, and more preferably a hydroxy-containing acrylic resin. The hydroxy-containing acrylic resin is preferably provided in the form of a hydroxy-containing acrylic emulsion. Examples of the curing agent include amino resins, polyisocyanate compounds, and blocked polyisocyanate compounds.

The aqueous medium for use may be water and/or at least one hydrophilic organic solvent. Examples of the hydrophilic organic solvent for use include methanol, ethanol, n-propyl alcohol, isopropyl alcohol, and ethylene glycol.

In addition to the above components, the aqueous base paint (X) for use in the method of the present invention may appropriately contain an effect pigment, a color pigment, an extender pigment, an ultraviolet absorber, a defoaming agent, a rheology control agent, a rust inhibitor, a surface-adjusting agent, and the like, if desired.

The effect pigment is used for the purpose of imparting brilliance to the resulting coating film. Examples include aluminum flake pigment, vapor deposition aluminum flake pigment, metal-oxide-coated aluminum flake pigment, colored aluminum flake pigment, mica, titanium-oxide-coated mica, iron-oxide-coated mica, micaceous iron oxide, titanium-oxide-coated silica, titanium-oxide-coated alumina, iron-oxide-coated silica, and iron-oxide-coated alumina. Of these, aluminum flake pigment is preferable. The aluminum flake pigment and the vapor deposition aluminum flake pigment are described in more detail in relation to a flake-aluminum pigment (A) and a flake-aluminum pigment (B) of an effect pigment dispersion (Y).

When the effect pigment is contained, the amount is preferably 0.1 to 30 parts by mass, and more preferably 1 to 20 parts by mass, per 100 parts by mass of the resin solids content of the paint.

The color pigment is used to impart a desired color to the resulting coating film. Examples include white pigment, such as titanium oxide; black pigment, such as carbon black, acetylene black, lamp black, carbon black, graphite, iron black, and aniline black; red pigment, such as perylene maroon, red iron oxide, naphthol AS-based azo red, anthanthrone, anthraquinonyl red, quinacridone red pigment, diketopyrrolopyrrole, watching red, and permanent red; yellow pigment, such as yellow iron oxide, titanium yellow, monoazo yellow, condensed azo yellow, azomethine yellow, bismuth vanadate, benzimidazolone, isoindolinone, isoindoline, quinophthalone, benzidine yellow, and permanent yellow; orange pigment, such as permanent orange; purple pigment, such as cobalt purple, quinacridone violet, and dioxazine violet; blue pigment, such as cobalt blue, phthalocyanine blue, and threne blue; and green pigment, such as phthalocyanine green.

When the color pigment is contained, the amount is preferably 0.1 to 30 parts by mass, and more preferably 1 to 20 parts by mass, per 100 parts by mass of the resin solids content of the paint.

The rheology control agent is a material used to impart a desired viscosity to the paint. Examples include cellulose-based rheology control agents, polyamide-based rheology control agents, mineral-based rheology control agents, and polyacrylic acid-based rheology control agents. Of these, polyacrylic acid-based rheology control agents are particularly preferable.

When the rheology control agent is contained, the amount is preferably 0.1 to 10 parts by mass, and more preferably 0.5 to 5 parts by mass, per 100 parts by mass of the resin solids content of the paint.

The aqueous base paint (X) is applied by using a rotary-atomization bell-shaped coater under coating conditions of a shaping air pressure of 0.15 to 0.25 MPa and a paint discharge amount of 100 to 300 $cm^3$/min.

When application is performed under the above conditions, defects such as sagging can be reduced, and excellent smoothness of the base coating film is obtained, resulting in excellent finished appearance and luster of the resulting multilayer coating film.

The viscosity 60 seconds after the application of the aqueous base paint (X) under the above conditions, measured at a temperature of 23° C. and a shear rate of 0.1 $sec^{-1}$, is 90 to 160 Pa·s, the solids content 60 seconds after the application is 20 to 40 mass %, and the film thickness 60 seconds after the application is 17 to 35 μm, whereby the resulting multilayer coating film has excellent finished appearance and luster.

In this specification, the viscosity 60 seconds after the application of the aqueous base paint (X) is measured as follows. Specifically, the aqueous base paint (X) is applied to a tin plate (length: 45 mm×width: 30 mm×thickness: 0.8 mm), and a portion of the coating film 60 seconds after the application of the aqueous base paint (X) to the tin plate is scraped off with a spatula or the like. Then, the viscosity of the collected coating film is measured with a viscotester at a temperature of 23° C. and a shear rate of 0.1 $sec^{-1}$ when the shear rate is varied from 10,000 $sec^{-1}$ to 0.001 $sec^{-1}$. The viscotester for use may be, for example, a HAAKE Rheo-Stress RS150 (trade name, produced by HAAKE). The viscosity 60 seconds after the application of the aqueous base paint (X) can be adjusted, for example, by adjusting the amount of the rheology control agent and the solids content in the aqueous base paint (X).

If the viscosity 60 seconds after the application of the aqueous base paint (X), measured at a temperature of 23° C. and a shear rate of 0.1 $sec^{-1}$, is less than 90 Pa·s, the coating film appearance of the resulting multilayer coating film may be unsatisfactory in terms of at least one of the following aspects: smoothness, sagging, and unevenness. If the viscosity 60 seconds after the application of the aqueous base paint (X) exceeds 160 Pa·s, the coating film appearance of the resulting multilayer coating film may be unsatisfactory in terms of smoothness.

In this specification, the solids content 60 seconds after the application of the aqueous base paint (X) is measured as follows. Specifically, the aqueous base paint (X) is applied to an aluminum foil whose mass (M1) has been measured in advance, and the aluminum foil 60 seconds after the application of the aqueous base paint (X) is collected to measure the mass (M2). The collected aluminum foil is then dried at 110° C. for 60 minutes, cooled to room temperature in a desiccator, and the mass (M3) of the aluminum foil is measured to determine the solids content according to the following formula.

$$\text{Solids content (mass \%)}=\{(M3-M1)/(M2-M1)\}\times 100$$

In this specification, the film thickness 60 seconds after the application can be determined by applying the aqueous base paint (X) to aluminum foil whose mass has been measured in advance, measuring the mass 60 seconds after the application of the aqueous base paint (X) to the aluminum foil, and using the following formula.

$$x = sc/sg/S * 10000 \qquad \text{Formula}$$

x: the film thickness 60 seconds after the application (μm)
sc: the mass 60 seconds after the application (g)
sg: the specific gravity of the paint (g/$cm^3$)
S: the evaluation area of coated mass ($cm^2$)

In the present invention, the viscosity 60 seconds after the application of the aqueous base paint (X), the solids content 60 seconds after the application of the aqueous base paint (X), and the film thickness 60 seconds after the application can be measured by applying the aqueous base paint (X) to a tin plate or aluminum foil according to the measurement methods defined as above in step (5) of the method for forming a multilayer coating film of the present invention.

If the film thickness 60 seconds after the application of the aqueous base paint (X) is less than 17 μm, the coating film appearance of the resulting multilayer coating film may be unsatisfactory in terms of smoothness. If the film thickness 60 seconds after the application of the aqueous base paint (X) exceeds 35 μm, the coating film appearance of the resulting multilayer coating film may be unsatisfactory in terms of at least one of the following: smoothness, sagging, and unevenness.

The base coating film formed from the aqueous base paint (X) has a film thickness of preferably 4 to 14 μm, and more preferably 6 to 13 μm, on a cured coating film basis, from the standpoint of, for example, obtaining a multilayer coating film with excellent finished appearance and luster.

The uncured base coating film obtained by applying the aqueous base paint (X) may be allowed to stand at an ordinary temperature for 15 to 30 minutes or may be heated at 50 to 100° C. for 30 seconds to 10 minutes. Subsequently, the application of an effect pigment dispersion (Y) can be performed.

Step (6)

In step (6) in the present invention, an effect pigment dispersion (Y) is applied to the uncured base coating film to form an uncured effect coating film.

Effect Pigment Dispersion (Y)

In this specification, the term "effect pigment dispersion (Y)" refers to an aqueous paint that contains a flake-aluminum pigment (A) with an average thickness of 1 nm or more and less than 70 nm, a flake-aluminum pigment (B) with an average thickness of 70 nm to 250 nm, a hydroxy-containing acrylic resin (C), a rheology control agent (D), a surface-adjusting agent (E), and water, and that has a solids content of 2 to 9 mass %. The effect pigment dispersion (Y) is used to impart luster.

Examples of the flake-aluminum pigment (A) with an average thickness of 1 nm or more and less than 70 nm include vapor deposition aluminum flake pigment.

The vapor deposition aluminum flake pigment is obtained by vapor-depositing an aluminum film on a base material, removing the base material, and then grinding the vapor deposition aluminum film. Examples of the base material include films.

The vapor deposition aluminum flake pigment is preferably surface-treated with silica from the standpoint of, for example, obtaining a coating film excellent in storage stability and metallic luster.

Examples of commercial products that can be used as the vapor deposition aluminum flake pigment include Metalure series (trade name, produced by Eckart), Hydroshine WS series (trade name, produced by Eckart), Decomet series (trade name, produced by Schlenk), and Metasheen series (trade name, produced by BASF).

The content of the flake-aluminum pigment (A) with an average thickness of 1 nm or more and less than 70 nm is preferably 15 to 60 parts by mass, and more preferably 30 to 50 mass parts, per 100 mass parts of the solids content of the effect pigment dispersion (Y).

Examples of the flake-aluminum pigment (B) with an average thickness of 70 nm to 250 nm include aluminum flake pigment.

The aluminum flake pigment is typically produced by crushing and grinding aluminum using a grinding aid in a ball mill or attritor mill, in the presence of a grinding liquid medium. Grinding aids for use in the production step of the aluminum flake pigment include higher fatty acids, such as oleic acid, stearic acid, isostearic acid, lauric acid, palmitic acid, and myristic acid; as well as aliphatic amines, aliphatic amides, and aliphatic alcohols. Grinding liquid media for use include aliphatic hydrocarbons, such as a mineral spirit.

The aluminum flake pigment is broadly categorized into leafing aluminum flake pigments and non-leafing aluminum flake pigments, according to the type of grinding aid. From the standpoint of forming a minute metallic coating film that exhibits excellent water resistance, high gloss in highlight, and lower graininess, a non-leafing flake-aluminum pigment is preferably used in the effect pigment dispersion according to the present invention. The non-leafing flake-aluminum pigments for use may be those whose surface is not particularly treated, those whose surface is coated with a resin, those whose surface is treated with silica, or those whose surface is treated with phosphoric acid, molybdic acid, or a silane coupling agent. The non-leafing flake-aluminum pigment for use may be a non-leafing flake-aluminum pigment subjected to one or several of these surface treatments.

The content of the flake-aluminum pigment (B) with an average thickness of 70 nm to 250 nm is preferably 15 to 60 parts by mass, and more preferably 30 to 50 parts by mass, per 100 parts by mass of the solids content of the effect pigment dispersion (Y).

The mass ratio of the mixture of the flake-aluminum pigment (A) with an average thickness of 1 nm or more and less than 70 nm and the flake-aluminum pigment (B) with an average thickness of 70 nm to 250 nm is preferably 9/1 to 1/9, and more preferably 2/8 to 8/2.

The average thickness of the flake-aluminum pigment (A) with an average thickness of 1 nm or more and less than 70 nm or the flake-aluminum pigment (B) with an average thickness of 70 nm to 250 nm is defined as the average value determined by observing the cross-sectional surface of a coating film that contains the effect pigment with a microscope, measuring the thickness using image processing software, and calculating the average value of 100 or more particles.

The hydroxy-containing acrylic resin (C) can be produced, for example, by (co)polymerization of at least one unsaturated monomer component that contains a hydroxy-containing unsaturated monomer and one or more other unsaturated monomers copolymerizable with the hydroxy-containing unsaturated monomer, under ordinary conditions.

The hydroxy-containing unsaturated monomer is a compound containing one or more hydroxy groups and one or more polymerizable unsaturated bonds per molecule. Examples include monoesterified products of (meth)acrylic acid with a dihydric alcohol having 2 to 8 carbon atoms (e.g., 2-hydroxyethyl (meth)acrylate, 2-hydroxypropyl (meth) acrylate, 3-hydroxypropyl (meth)acrylate, and 4-hydroxybutyl (meth)acrylate); ε-caprolactone-modified products of such monoesterified products of (meth)acrylic acid with a dihydric alcohol having 2 to 8 carbon atoms; allyl alcohol; and (meth)acrylates that include a hydroxy-terminated polyoxyethylene chain.

In this specification, "(meth)acrylate" is the general name of acrylates and methacrylates, and "(meth)acrylic acid" is the general name of acrylic acids and methacrylic acids.

Examples of other unsaturated monomers copolymerizable with the hydroxy-containing unsaturated monomer include alkyl or cycloalkyl (meth)acrylate, such as methyl (meth)acrylate, ethyl (meth)acrylate, n-propyl (meth)acrylate, i-propyl (meth)acrylate, n-butyl (meth)acrylate, i-butyl (meth)acrylate, tert-butyl (meth)acrylate, n-hexyl (meth) acrylate, octyl (meth)acrylate, 2-ethylhexyl (meth)acrylate, nonyl (meth)acrylate, tridecyl (meth)acrylate, lauryl (meth) acrylate, stearyl (meth)acrylate, Isostearyl Acrylate (trade name, produced by Osaka Organic Chemical Industry Ltd.), cyclohexyl (meth)acrylate, methylcyclohexyl (meth)acrylate, t-butylcyclohexyl (meth)acrylate, and cyclododecyl (meth)acrylate; isobornyl-containing unsaturated monomers, such as isobornyl (meth)acrylate; adamantyl-containing unsaturated monomers, such as adamantyl (meth) acrylate; aromatic ring-containing unsaturated monomers, such as styrene, α-methylstyrene, vinyltoluene, and phenyl (meth)acrylate; alkoxysilyl-containing unsaturated monomers, such as vinyltrimethoxysilane, vinyltriethoxysilane, vinyltris(2-methoxyethoxy)silane, γ-(meth)acryloyloxypropyltrimethoxysilane, and γ-(meth)acryloyloxypropyltriethoxysilane; perfluoroalkyl (meth)acrylates, such as perfluorobutylethyl (meth)acrylate and perfluorooctylethyl (meth)acrylate; fluorinated alkyl-containing unsaturated monomers, such as fluoroolefin; unsaturated monomers having photopolymerizable functional groups, such as maleimide; vinyl compounds, such as N-vinylpyrrolidone, ethylene, butadiene, chloroprene, vinyl propionate, and vinyl acetate; carboxy-containing unsaturated monomers, such as (meth) acrylic acid, maleic acid, crotonic acid, and β-carboxyethyl acrylate; nitrogen-containing unsaturated monomers, such as (meth)acrylonitrile, (meth)acrylamide, dimethylaminopropyl (meth)acrylamide, dimethylaminoethyl (meth)acrylate, and adducts of glycidyl (meth)acrylate with amines; epoxy-containing unsaturated monomers, such as glycidyl (meth)acrylate, β-methylglycidyl (meth)acrylate, 3, 4-epoxycyclohexylmethyl (meth)acrylate, 3,4-epoxycyclohexylethyl (meth)acrylate, 3,4-epoxycyclohexylpropyl (meth) acrylate, and allyl glycidyl ether; (meth)acrylates having alkoxy-terminated polyoxyethylene chains; sulfonic acid group-containing unsaturated monomers, such as 2-acrylamide-2-methylpropanesulfonic acid, allylsulfonic acid, styrene sulfonic acid sodium salt, sulfoethyl methacrylate, and sodium salts and ammonium salts thereof; phosphoric acid group-containing unsaturated monomers, such as 2-acryloyloxyethyl acid phosphate, 2-methacryloyloxyethyl acid phosphate, 2-acryloyloxypropyl acid phosphate, and 2-methacryloyloxypropyl acid phosphate; UV-absorbing group-containing unsaturated monomers, such as 2-hydroxy-4-(3-methacryloyloxy-2-hydroxypropoxy)benzophenone, 2-hydroxy-4-(3-acryloyloxy-2-hydroxypropoxy)benzophenone, 2,2'-dihydroxy-4-(3-methacryloyloxy-2-hydroxypropoxy)benzophenone, 2,2'-dihydroxy-4-(3-acryloyloxy-2-hydroxypropoxy)benzophenone, and 2-(2'-hydroxy-5'-methacryloyloxyethylphenyl)-2H-benzotriazole; unsaturated monomers having UV stabilization properties, such as 4-(meth)acryloyloxy-1,2,2,6,6-pentamethylpiperidine, 4-(meth)acryloyloxy-2,2,6,6-tetramethylpiperidine, 4-cyano-4-(meth)acryloylamino-2,2,6,6-tetramethylpiperidine, 1-(meth)acryloyl-4-(meth) acryloylamino-2,2,6,6-tetramethylpiperidine, 1-(meth) acryloyl-4-cyano-4-(meth)acryloylamino-2,2,6,6-tetramethylpiperidine, 4-crotonoyloxy-2,2,6,6-tetramethylpiperidine, 4-crotonoylamino-2,2,6,6-tetramethylpiperidine, and 1-crotonoyl-4-crotonoyloxy-2,2,6,6-tetramethylpiperidine; and carbonyl-containing unsaturated monomer compounds, such as acrolein, diacetone acrylamide, diacetone methacrylamide, acetoacetoxyethyl methacrylate, formylstyrol, and $C_{4-7}$ vinyl alkyl ketones (e.g., vinyl methyl ketone, vinyl ethyl ketone, and vinyl butyl ketone). These may be used singly or in a combination of two or more.

The content of the hydroxy-containing acrylic resin (C) is preferably 10 to 40 parts by mass, and more preferably 15 to 35 parts by mass, per 100 parts by mass of the solids content of the effect pigment dispersion (Y).

The rheology control agent (D) for use may be, for example, a cellulose-based rheology control agent, a polyamide-based rheology control agent, a mineral-based rheology control agent, or a polyacrylic acid-based rheology control agent. Of these, a cellulose-based rheology control agent is preferable.

Examples of cellulose-based rheology control agents include carboxymethylcellulose, methylcellulose, hydroxyethyl cellulose, hydroxyethyl methylcellulose, hydroxypropyl methylcellulose, cellulose nanofibers, and cellulose nanocrystals. Of these, cellulose nanofibers are preferable for use.

The cellulose nanofibers have a numerical average fiber diameter of preferably 2 to 500 nm, more preferably 2 to 250 nm, and still more preferably 2 to 150 nm, and have a numerical average fiber length of preferably 0.1 to 20 μm, more preferably 0.1 to 15 μm, and still more preferably 0.1 to 10 μm.

The numerical average fiber diameter and numerical average fiber length are measured and calculated from, for example, an image obtained by subjecting a sample (cellulose nanofibers diluted with water) to a dispersion treatment, casting the sample on a grid coated with a carbon film that has been subjected to hydrophilic treatment, and observing the sample with a transmission electron microscope (TEM).

The cellulose nanofibers for use may be those obtained by defibrating a cellulose material and stabilizing it in water. The cellulose material as used here refers to cellulose-main materials in various forms. Specific examples include pulp (e.g., grass plant-derived pulp, such as wood pulp, jute, Manila hemp, and kenaf); natural cellulose, such as cellulose produced by microorganisms; regenerated cellulose obtained by dissolving cellulose in a copper ammonia solution or a solvent such as a morpholine derivative, and subjecting the dissolved cellulose to spinning; and fine cellulose obtained by subjecting the cellulose material to mechanical treatment, such as hydrolysis, alkali hydrolysis, enzymatic decomposition, blasting treatment, or vibration ball milling, to depolymerize the cellulose.

Cellulose nanofibers for use may be anionically modified cellulose nanofibers. Examples of anionically modified cellulose nanofibers include carboxylated cellulose nanofibers, carboxymethylated cellulose nanofibers, sulfonic acid group-containing cellulose nanofibers, and phosphate-group-containing cellulose nanofibers. The anionically modified cellulose nanofibers can be obtained, for example, by incorporating functional groups such as carboxyl groups and carboxymethyl groups into a cellulose material by a known method, washing the obtained modified cellulose to prepare a dispersion of the modified cellulose, and defibrating this dispersion. The carboxylated cellulose is also referred to as "oxidized cellulose."

The oxidized cellulose can be obtained, for example, by oxidizing the cellulose material in water using an oxidizing agent in the presence of a compound selected from the group consisting of an N-oxyl compound, a bromide, an iodide, and a mixture thereof.

Examples of commercial products of cellulose nanofibers include Rheocrysta (registered trademark) produced by DKS Co., Ltd., and Aurovisc (registered trademark) produced by Oji Holdings Corporation.

The content of the rheology control agent (D) is preferably 10 to 40 parts by mass, and more preferably 15 to 35 parts by mass, per 100 parts by mass of the solids content of the effect pigment dispersion (Y).

Examples of the surface-adjusting agent (E) include surface-adjusting agents such as silicone-based surface-adjusting agents, acrylic-based surface-adjusting agents, vinyl-based surface-adjusting agents, fluorine-based surface-adjusting agents, and acetylene-diol-based surface-adjusting agents. Of these, acetylene-diol-based surface-adjusting agents are preferable.

Examples of commercial products of surface-adjusting agent (E) include the Dynol series, Surfynol series, and Tego series (produced by Evonik Industries AG), BYK series (produced by BYK-Chemie), Glanol series and Polyflow series (produced by Kyoeisha Chemical Co., Ltd.), and Disparlon series (produced by Kusumoto Chemicals, Ltd.).

The content of the surface-adjusting agent (E) is preferably 5 to 25 parts by mass, and more preferably from 10 to 20 parts by mass, per 100 parts by mass of the solids content of the effect pigment dispersion (Y).

The effect pigment dispersion (Y) has a solids content of 2 to 9 mass %. When the solids content is 2 to 9 mass %, the resulting multilayer coating film has excellent luster.

The effect pigment dispersion (Y) may further appropriately contain a resin other than the hydroxy-containing acrylic resin (C), a color pigment, an extender pigment, an organic solvent, a pigment dispersant, a pigment derivative, an anti-settling agent, a defoaming agent, an ultraviolet absorber, a light stabilizer, and the like, if necessary.

The effect pigment dispersion (Y) can be applied by general-purpose methods commonly used in this field. Examples of the coating method include coating methods using a brush or a coater. Among these, a coating method using a coater is preferable. For example, the coater is preferably an airless spray coater, an air spray coater, and a rotary-atomization electrostatic coater, such as a paint cassette coater, and is particularly preferably a rotary-atomization electrostatic coater. The use of the above paint and coating method can form an uncured effect coating film with excellent coating appearance.

The effect coating film formed from the effect pigment dispersion (Y) has a thickness of 0.5 and 2.0 μm on a cured coating film basis. When the effect coating film has a thickness of 0.5 to 2.0 μm on a cured coating film basis, the resulting multilayer coating film has excellent luster.

The uncured effect coating film obtained by applying the effect pigment dispersion (Y) may be allowed to stand at an ordinary temperature for 15 to 30 minutes or may be heated at 50 to 100° C. for 30 seconds to 10 minutes. Subsequently, the application of a clear paint (Z) can be performed.

Step (7)

In step (7) of the present invention, a clear paint (Z) is applied to the uncured effect coating film to form an uncured clear coating film.

Clear Paint (Z)

In this specification, the term "clear paint (Z)" refers to a transparent paint used to protect the base coating film and the effect coating film.

The clear paint (Z) for use in this step is preferably a paint that is commonly used in this field and that contains a base resin, a curing agent, and a medium comprising water or an organic solvent. The base resin and the curing agent here may be known compounds that are commonly used in this field. Examples of the base resin include carboxy-containing acrylic resins, epoxy-containing acrylic resins, and hydroxy-containing acrylic resins. Examples of the curing agent for use include melamine resins, urea resins, polyisocyanate compounds, and blocked polyisocyanate compounds.

Examples of the organic solvent include hydrocarbons, such as aliphatic hydrocarbons (e.g., hexane and heptane), aromatic hydrocarbons (e.g., xylene and toluene), and alicyclic hydrocarbons; esters, such as ethyl acetate and butyl acetate; ethers, such as ethylene glycol monomethyl ether; alcohols, such as ethanol, propanol, and 2-ethylhexyl alcohol; ketones, such as methyl ethyl ketone and methyl isobutyl ketone; amides; and other solvents. Examples of organic solvents containing aromatic hydrocarbons include Swasol 310 and Swasol 1000 (produced by Cosmo Oil Co., Ltd.).

In addition to the above components, the clear paint (Z) for use in the method of the present invention may contain a color pigment, an effect pigment, an extender pigment, an ultraviolet absorber, a defoaming agent, a thickener, a rust inhibitor, a surface-adjusting agent, and the like, if desired.

Coating of the clear paint (Z) having the above structure can form a clear coating film having a sufficient thickness on a dry coating film basis to protect the base coating film and the effect coating film, and having excellent surface smoothness.

The clear paint (Z) can be applied by general-purpose methods commonly used in this field. Examples of the coating method include coating methods using a brush or a coater. Among these, a coating method using a coater is preferable. For example, the coater is preferably an airless spray coater, an air spray coater, or a rotary-atomization electrostatic coater, such as a paint cassette coater, and is particularly preferably a rotary-atomization electrostatic coater. The use of the above paint and coating method can form an uncured clear coating film with excellent coating appearance.

The clear coating film formed from the clear paint (Z) has a thickness of preferably 15 to 60 μm, and particularly preferably 25 to 45 μm, on a cured coating film basis, from the standpoint of, for example, obtaining a multilayer coating film with excellent finished appearance and luster.

Step (8)

In step (8) of the present invention, the uncured base coating film, the uncured effect coating film, and the uncured clear coating film are heated to simultaneously cure these coating films.

The heating may be performed by, for example, hot-air heating, infrared heating, or high-frequency heating. The heating temperature is preferably 80 to 160° C., and more preferably 100 to 140° C. The heating time is preferably 10 to 60 minutes, and more preferably 15 to 40 minutes.

EXAMPLES

Below, the present invention is described in more detail with reference to Production Examples, Examples, and Comparative Examples. These Production Examples, Examples, and Comparative Examples are mere examples, and are not intended to restrict the scope of the present invention. In the Production Examples, Examples, and Comparative Examples, parts and percentages are based on mass unless otherwise specified. The thickness of a coating film is based on its cured coating film.

Production of Hydroxy-Containing Acrylic Resin

Production Example 1

128 parts of deionized water and 2 parts of Adeka Reasoap SR-1025 (trade name, produced by Adeka, an emulsifier, active ingredient: 25%) were placed in a reaction vessel equipped with a thermometer, a thermostat, a stirrer, a reflux condenser, a nitrogen inlet tube, and a dropping funnel. The mixture was stirred and mixed in a nitrogen flow, and heated to 80° C.

Subsequently, 1% of the entire amount of monomer emulsion for the core portion, which is described below, and 5.3 parts of a 6% ammonium persulfate aqueous solution were introduced into the reaction vessel and maintained therein at 80° C. for 15 minutes. Thereafter, the remaining monomer emulsion for the core portion was added dropwise over a period of 3 hours to the reaction vessel maintained at the same temperature. After completion of the dropwise addition, the mixture was aged for 1 hour. Subsequently, a monomer emulsion for the shell portion, which is described below, was added dropwise to the reaction vessel over a period of 1 hour, followed by aging for 1 hour. Thereafter, the mixture was cooled to 30° C. while gradually adding 40 parts of a 5% 2-(dimethylamino)ethanol aqueous solution to the reaction vessel, and filtered through a 100-mesh nylon cloth, thereby obtaining a hydroxy-containing acrylic resin emulsion (R-1) having an average particle size of 100 nm and a solids content of 30%. The obtained hydroxy-containing acrylic resin emulsion (R-1) had an acid value of 33 mg KOH/g, and a hydroxy value of 25 mg KOH/g.

Monomer emulsion for the core portion: 40 parts of deionized water, 2.8 parts of Adeka Reasoap SR-1025, 2.1 parts of methylene bisacrylamide, 2.8 parts of styrene, 16.1 parts of methyl methacrylate, 28 parts of ethyl acrylate, and 21 parts of n-butyl acrylate were mixed and stirred, thereby obtaining a monomer emulsion for the core portion.

Monomer emulsion for the shell portion: 17 parts of deionized water, 1.2 parts of Adeka Reasoap SR-1025, 0.03 parts of ammonium persulfate, 3 parts of styrene, 5.1 parts of 2-hydroxyethyl acrylate, 5.1 parts of methacrylic acid, 6 parts of methyl methacrylate, 1.8 parts of ethyl acrylate, and 9 parts of n-butyl acrylate were mixed and stirred, thereby obtaining a monomer emulsion for the shell portion.

Production Example 2

35 parts of propylene glycol monopropyl ether were placed in a reaction vessel equipped with a thermometer, a thermostat, a stirrer, a reflux condenser, a nitrogen inlet tube, and a dropping funnel, and heated to 85° C. Subsequently, a mixture comprising 30 parts of methyl methacrylate, 20 parts of 2-ethylhexyl acrylate, 29 parts of n-butyl acrylate, 15 parts of 2-hydroxyethyl acrylate, 6 parts of acrylic acid, 15 parts of propylene glycol monopropyl ether, and 2.3 parts of 2,2'-azobis(2,4-dimethylvaleronitrile) was added dropwise thereto over a period of 4 hours. After completion of the dropwise addition, the mixture was aged for 1 hour. Subsequently, a mixture of 10 parts of propylene glycol monopropyl ether and 1 part of 2,2'-azobis(2,4-dimethylvaleronitrile) was further added dropwise thereto over a period of 1 hour. After completion of the dropwise addition, the mixture was aged for 1 hour. 7.4 parts of diethanolamine were further added thereto, thereby obtaining a hydroxy-containing acrylic resin solution (R-2) having a solids content of 55%. The obtained hydroxy-containing acrylic resin solution (R-2) had an acid value of 47 mg KOH/g, a hydroxy value of 72 mg KOH/g, and a weight average molecular weight of 58,000.

Production Example 3

A mixed solvent of 27.5 parts of methoxypropanol and 27.5 parts of isobutanol was placed in a reaction vessel equipped with a thermometer, a thermostat, a stirrer, a reflux condenser, a nitrogen gas inlet tube, and a dropping funnel, and heated to 110° C. 121.5 parts of a mixture comprising 25.0 parts of styrene, 27.5 parts of n-butyl methacrylate, 20.0 parts of Isostearyl Acrylate (trade name, produced by Osaka Organic Chemical Industry Ltd., branched higher alkyl acrylate), 7.5 parts of 4-hydroxybutyl acrylate, 15.0 parts of the following phosphate group-containing polymerizable monomer, 12.5 parts of 2-methacryloyloxyethyl acid phosphate, 10.0 parts of isobutanol, and 4.0 parts of t-butylperoxy octanoate was added to the above mixed solvent over a period of 4 hours. Further, a mixture comprising 0.5 parts of t-butylperoxy octanoate and 20.0 parts of isopropanol was added dropwise for 1 hour. Then, the resulting product was stirred and aged for 1 hour, thereby obtaining an acrylic resin solution (R-3) containing a hydroxy group and phosphate group and having a solids content of 50%. The obtained acrylic resin solution (R-3) containing a hydroxy group and phosphate group had an acid value of 83 mgKOH/g, a hydroxy value of 29 mgKOH/g, and a weight average molecular weight of 10,000.

Phosphate group-containing polymerizable monomer: 57.5 parts of monobutyl phosphoric acid and 41.0 parts of isobutanol were placed in a reaction vessel equipped with a thermometer, a thermostat, a stirrer, a reflux condenser, a nitrogen gas inlet tube, and a dropping funnel, and heated to 90° C. After 42.5 parts of glycidyl methacrylate was added dropwise over 2 hours, the mixture was stirred and aged for 1 hour. Thereafter, 59.0 parts of isopropanol were added, thereby obtaining a phosphate group-containing polymerizable monomer solution having a solids concentration of 50%. The acid value of the obtained monomer was 285 mgKOH/g.

Production of Hydroxy-Containing Polyester Resin Solution

Production Example 4

109 parts of trimethylolpropane, 141 parts of 1,6-hexanediol, 126 parts of 1,2-cyclohexanedicarboxylic anhydride, and 120 parts of adipic acid were placed in a reaction vessel equipped with a thermometer, a thermostat, a stirrer, a reflux condenser, and a water separator. The mixture was heated from 160° C. to 230° C. over a period of 3 hours, followed by a condensation reaction at 230° C. for 4 hours. Subsequently, a carboxyl group was introduced into the obtained condensation reaction product by adding 38.3 parts of trimellitic anhydride, followed by a reaction at 170° C. for 30 minutes. Thereafter, the product was diluted with 2-ethyl-1-hexanol, thereby obtaining a hydroxy-containing polyester resin solution (R-4) having a solids content of 70%. The obtained hydroxy-containing polyester resin (R-4) had an acid value of 46 mg KOH/g, a hydroxy value of 150 mg KOH/g, and a number average molecular weight of 1,400.

Production of Blocked Polyisocyanate Compound

Production Example 5

360 parts of Sumidur N-3300 (trade name, produced by Sumika Bayer Urethane Co., Ltd., Sumidur being a registered trademark, polyisocyanate having a hexamethylene diisocyanate-derived isocyanurate structure, solids content: about 100%, percentage of isocyanate group content: 21.8%), 60 parts of Uniox M-550 (trade name, produced by NOF Corporation, Uniox being a registered trademark, polyethylene glycol monomethyl ether, average molecular weight: about 550), and 0.2 parts of 2,6-di-tert-butyl-4-methylphenol were placed in a reaction vessel equipped with a thermometer, a thermostat, a stirrer, a reflux condenser, a nitrogen inlet tube, a dropping funnel, and a simplified trap for the removed solvent. The mixture was sufficiently mixed and heated in a nitrogen stream at 130° C. for 3 hours. Subsequently, 110 parts of ethyl acetate, and 252 parts of diisopropyl malonate were added. While the mixture was stirred in a nitrogen stream, 3 parts of a 28% methanol solution of sodium methoxide were added thereto, and the mixture was stirred at 65° C. for 8 hours. The amount of isocyanate in the obtained resin solution was 0.12 mol/kg. 683 parts of 4-methyl-2-pentanol were added thereto, and while the temperature of the reaction system was maintained at 80 to 85° C., the solvent was distilled off under reduced pressure over a period of 3 hours, thereby obtaining 1010 parts of a blocked polyisocyanate compound (R-5). 95 parts of isopropanol were contained in the simplified trap for the removed solvent. The obtained blocked polyisocyanate compound (R-5) had a solids concentration of 60%.

Production of Color Pigment Dispersion

Production Example 6

5.5 parts (resin solids content: 3 parts) of the hydroxy-containing acrylic resin solution (R-2) obtained in Production Example 2, 0.2 parts of Carbon MA-100 (trade name, produced by Mitsubishi Chemical Corporation, carbon black pigment), and 20 parts of deionized water were mixed. After the pH of the mixture was adjusted to 8.2 with 2-(dimethylamino)ethanol, the mixture was dispersed using a paint shaker for 30 minutes, thereby obtaining a color pigment dispersion (P-1).

Production of Extender Pigment Dispersion

Production Example 7

5.5 parts (resin solids content: 3 parts) of the hydroxy-containing acrylic resin solution (R-2) obtained in Production Example 2, 10 parts of Barifine BF-20 (trade name, produced by Sakai Chemical Industry Co., Ltd., barium sulfate pigment), 0.6 parts (solids content: 0.3 parts) of Surfynol 104A (trade name, produced by Air Products, defoaming agent, solids content: 50%), and 20 parts of deionized water were mixed. The mixture was dispersed using a paint shaker for 1 hour, thereby obtaining an extender pigment dispersion (P-2).

Production of Effect Pigment Dispersion

Production Example 8

In a vessel for stirring and mixing, 8 parts (solids content: 6 parts) of Alpaste TCR2060 (trade name, produced by Toyo Aluminium K.K., an aluminum pigment paste, aluminum content: 75%), 35.0 parts of 2-ethyl-1-hexanol, and 8 parts (solids content 4 parts) of the acrylic resin solution (R-3) containing a hydroxy group and phosphate group obtained in Production Example 3 were uniformly mixed, thereby obtaining an effect pigment dispersion (P-3).

Production of Aqueous Base Paint (X)

Production Example 9

116.7 parts (solids content: 35 parts) of the hydroxy-containing acrylic resin emulsion (R-1) obtained in Production Example 1, 35.7 parts (solids content: 25 parts) of the polyester resin solution (R-4) obtained in Production Example 4, 25 parts (solids content: 15 parts) of the blocked polyisocyanate compound (R-5) obtained in Production Example 5, 23.8 parts of the color pigment dispersion (P-1) obtained in Production Example 6, 34.2 parts of the extender pigment dispersion (P-2) obtained in Production Example 7, 19 parts of the effect pigment dispersion (P-3) obtained in Production Example 8, 21.4 parts (solids content: 15 parts) of melamine resin (weight average molecular weight: 1,200, solids content: 70%), and 5.4 parts (solids content: 1.5 parts) of Primal ASE-60 (trade name, produced by The Dow Chemical Company, a thickener, solids content: 28%) were uniformly mixed. Further, 2-(dimethylamino)ethanol and deionized water were added to the mixture, thereby obtaining an aqueous base paint (X-1) having a pH of 8.0, a paint solids content of 23%, and a paint viscosity B6 value of 4500 mPa·s measured at a temperature of 23° C. The B6 value is the viscosity one minute after rotation at a rotor rotational speed of 6 rpm measured with a Brookfield type viscometer. For the Brookfield type viscometer, a VDA digital Vismetron viscometer (produced by Shibaura System Co. Ltd.) was used.

Production Examples 10 to 14

Aqueous base paints (X-2) to (X-6) having a pH of 8.0 were obtained in the same manner as in Production Example 9, except that the formulation, paint solids content, and viscosity were as shown in Table 1 below. The amounts of the components shown in Table 1 are expressed as solids content by mass.

TABLE 1

| Production Example | | 9 | 10 | 11 | 12 | 13 | 14 |
|---|---|---|---|---|---|---|---|
| Aqueous base paint (X) | | X-1 | X-2 | X-3 | X-4 | X-5 | X-6 |
| Hydroxy-containing acrylic resin emulsion (R-1) | | 35 | 35 | 35 | 35 | 35 | 35 |
| Polyester resin solution (R-4) | | 25 | 25 | 25 | 25 | 25 | 25 |
| Blocked polyisocyanate compound (R-5) | | 15 | 15 | 15 | 15 | 15 | 15 |
| Color pigment | Hydroxy-containing acrylic resin solution (R-2) | 3 | 3 | 3 | 3 | 3 | 3 |
| dispersion (P-1) | Carbon MA-100 | 0.2 | 0.2 | 0.2 | 0.2 | 0.2 | 0.2 |
| Extender pigment | Hydroxy-containing acrylic resin solution (R-2) | 3 | 3 | 3 | 3 | 3 | 3 |
| dispersion (P-2) | Barifine BF-20 | 10 | 10 | 10 | 10 | 10 | 10 |
| | Surfynol 104A | 0.3 | 0.3 | 0.3 | 0.3 | 0.3 | 0.3 |
| Effect pigment | Alpaste TCR2060 | 6 | 6 | 6 | 6 | 6 | 6 |
| dispersion (P-3) | Acrylic resin solution (R-3) containing hydroxy group and phosphate group | 4 | 4 | 4 | 4 | 4 | 4 |
| Melamine resin | | 15 | 15 | 15 | 15 | 15 | 15 |
| Primal ASE-60 | | 1.5 | 1.1 | 0.3 | 0 | 1.2 | 0.6 |
| Paint solids content (%) | | 23% | 23% | 26% | 26% | 20% | 23% |
| Viscosity (mPa · s) | | 4500 | 3000 | 3000 | 1000 | 1000 | 1000 |

Production of Effect Pigment Dispersion (Y)

Production Example 15

In a vessel for stirring and mixing, an acetylenediol-based surface-adjusting agent (solids content: 0.3 parts), Hydroshine WS-3001 (trade name, an aqueous vapor deposition aluminum flake pigment, produced by Eckart, average particle size D50: 13 μm, average thickness: 0.05 μm, the surface being treated with silica) (solids content: 1.2 parts), Alpaste EMR-B6360 (trade name, a non-leafing aluminum flake, produced by Toyo Aluminium K.K., average particle size D50: 10.3 μm, average thickness: 0.19 μm, the surface being treated with silica) (solids content: 0.4 parts), a phosphate-group-containing cellulose nanofiber aqueous dispersion (numerical average fiber diameter: 4 nm, the amount of phosphate groups introduced: 1.50 mmol/g) (solids content: 0.5 parts), the hydroxy-containing acrylic resin emulsion (R-1) obtained in Production Example 1 (solids content: 0.6 parts), a triazine ultraviolet absorber (solids content 0.1 parts), a hindered amine light stabilizer (solids content: 0.1 part), and the color pigment dispersion (P-1) obtained in Production Example 5 (solids content: 0.1 parts) were stirred and mixed. Then, a liquid mixture of water and isopropyl alcohol (water/isopropyl alcohol=6/1) was added, thereby preparing an effect pigment dispersion (Y-1) having a solids content of 3.3%. The paint viscosity B6 value was 2300 mPa·s.

Preparation of Solvent-Based Intermediate Paint (V)

Solvent-based Intermediate Paint (V-1): TP-90 No. 8101 Gray (trade name, produced by Kansai Paint Co., Ltd., a hydroxy/melamine and blocked isocyanate-curable one-component organic solvent-based paint) was used as a solvent-based intermediate paint (V-1).

Preparation of Solvent-Based Intermediate Paint (W)

Solvent-based intermediate paint (W-1): TP-58 No. 1C0 color base (trade name, produced by Kansai Paint Co., Ltd., a hydroxy/melamine-curable one-component organic solvent-based paint) was used as a solvent-based intermediate paint (W-1).

Preparation of Clear Paint (Z)

Clear paint (Z-1): KIN06510 (trade name, produced by Kansai Paint Co., Ltd., a hydroxy/isocyanate group-curable acrylic/urethane resin-based two-component organic solvent-based paint) was used as a clear paint (Z-1).

Production of Test Substrate

Elecron GT-10 (trade name, produced by Kansai Paint Co., Ltd., a thermosetting epoxy resin cationic electrodeposition paint composition) was applied by electrodeposition to a zinc phosphate-treated cold-rolled steel plate to a film thickness of 20 μm. The resulting film was cured by heating at 170° C. for 30 minutes, thereby obtaining a test substrate.

Production of Coated Test Plate

Example 1

The solvent-based intermediate paint (V-1) was electrostatically applied to the test substrate to a film thickness of 40 μm on a cured coating film basis using a rotary atomization electrostatic coater to form a first intermediate coating film. After being allowed to stand for 7 minutes, the first intermediate coating film was cured by heating at 140° C. for 30 minutes.

Next, the solvent-based intermediate paint (W-1) was electrostatically applied to the first intermediate coating film to a film thickness of 35 μm on a cured coating film basis using a rotary atomization electrostatic coater to form a second intermediate coating film. After being allowed to stand for 7 minutes, the second intermediate coating film was cured by heating at 140° C. for 30 minutes.

Next, the aqueous base paint (X-1) obtained in Production Example 9 was applied to the second intermediate coating film to a film thickness of 9 μm on a dry coating film basis using a Robot Bell (produced by ABB) at a booth temperature of 23° C. and a humidity of 68%. The discharge amount was 200 $cm^3$/min, and the shaping air pressure was 0.2 MPa. The resulting product was allowed to stand for 90 seconds to form an uncured base coating film. As described below, the aqueous base paint (X-1) obtained in Production Example 9 was also applied to a tin plate for viscosity measurement, aluminum foil for solids content measurement, and aluminum foil for film thickness measurement under the same coating conditions to measure the viscosity, the solids content, and the film thickness as described below.

Next, the effect pigment dispersion (Y-1) obtained in Production Example 15 was applied to the uncured base coating film using a Robot Bell (produced by ABB) at a booth temperature of 23° C. and a humidity of 68% to form a coating film with a film thickness of 1.0 μm on a dry coating film basis. The resulting product was allowed to stand for 3 min, followed by preheating at 80° C. for 3 min to thus form an effect coating film.

Next, the clear paint (Z-1) was applied to the uncured effect coating film using the Robot Bell (produced by ABB) at a booth temperature of 23° C. and a humidity of 68% to form a clear coating film with a film thickness of 35 μm on a dry coating film basis. After the application, the resulting product was allowed to stand at room temperature for 7 minutes and then heated at 140° C. for 30 minutes in a hot-air circulation drying oven to simultaneously dry the multilayer coating film, thereby obtaining a test plate.

Examples 2 to 6 and Comparative Examples 1 to 4

Test plates were obtained in the same manner as in Example 1, except that the paint, discharge amount, shaping air pressure, and dry film thickness were as shown in Table 2.

State of Paint 60 Seconds after Application

Viscosity

The aqueous base paints (X-1) to (X-6) were each applied to a tin plate of 45 cm (length)×30 cm (width)×0.8 mm (thickness) to achieve the discharge amount, shaping air pressure, and film thickness shown in Table 2. A portion of the coating film 60 seconds after the application of the aqueous base paint to the tin plate was scraped off with a spatula or the like, and the viscosity was measured with a HAAKE RheoStress RS150 (trade name, produced by HAAKE) at a temperature of 23° C. and a shear rate of 0.1 $sec^{-1}$ when the shear rate was varied from 10,000 $sec^{-1}$ to 0.001 $sec^{-1}$.

Solids Content

Each of the aqueous base paints (X-1) to (X-6) was applied to aluminum foil whose mass (M1) had been measured in advance to achieve the discharge amount, shaping air pressure, and film thickness shown in Table 2. The aluminum foil 60 seconds after the application of each of the aqueous base paints (X-1) to (X-6) to the aluminum foil was collected, and the mass (M2) was measured. The collected aluminum foil was dried at 110° C. for 60 minutes, cooled to room temperature in a desiccator, and the mass (M3) of the aluminum foil was measured to determine the solids content according to the following formula.

$$\text{The solids content (mass \%)} = \{(M3 - M1)/(M2 - M1)\} \times 100$$

Film Thickness

Each of the aqueous base paints (X-1) to (X-6) was applied to aluminum foil whose mass had been measured in advance, and the weight 60 seconds after the application of the aqueous base paint to the aluminum foil was measured to determine the film thickness according to the following formula.

$$x = sc/sg/S * 10000 \qquad \text{Formula}$$

x: the film thickness 60 seconds after the application (μm)
sc: the mass 60 seconds after the application (g)
sg: the specific gravity of the paint (g/cm$^3$)
S: the evaluation area of coated mass (cm$^2$)

Coating Film Evaluation

The test plates obtained in the manner described above were evaluated based on the following criteria. Table 2 shows the results.

60-Degree Specular Gloss (60 Degree Gloss)

The 60-degree gloss value of the test plates obtained above was measured using a glossmeter (micro-TRI-gloss, produced by BYK-Gardner). The higher the value, the better.

Finished Appearance: Smoothness

Each test plate was visually observed, and the degree of smoothness was evaluated according to the following criteria.

Pass: Excellent smoothness and excellent coating film appearance.

Fail: Poor smoothness and insufficient coating film appearance.

Finished Appearance: Sag

Each test plate was visually observed, and the degree of the occurrence of sagging was evaluated according to the following criteria.

Pass: No sag was observed, and the coating film appearance was excellent.

Fail: Sag was observed, and the coating film appearance was insufficient.

Finished Appearance: Unevenness

Each test plate was visually observed, and the degree of unevenness was evaluated according to the following criteria.

Pass: No unevenness was observed, and the coating film appearance was excellent.

Fail: Unevenness was observed, and the coating film appearance was insufficient.

TABLE 2

| | Example | | | | | |
|---|---|---|---|---|---|---|
| | 1 | 2 | 3 | 4 | 5 | 6 |
| Solvent-based intermediate paint (V) | V-1 | V-1 | V-1 | V-1 | V-1 | V-1 |
| Solvent-based intermediate paint (W) | W-1 | W-1 | W-1 | W-1 | W-1 | W-1 |
| Aqueous base paint (X) | X-1 | X-2 | X-3 | X-4 | X-5 | X-6 |
| Paint discharge amount in the application of aqueous base paint (X) (cm$^3$/min) | 200 | 200 | 178 | 178 | 154 | 134 |
| Shaping air pressure in the application of aqueous base paint (X) (MPa) | 0.2 | 0.2 | 0.2 | 0.2 | 0.2 | 0.2 |
| Viscosity 60 seconds after the application of aqueous base paint (X) (Pa · s) | 149 | 122 | 111 | 111 | 115 | 106 |
| Solids content 60 seconds after the application of aqueous base paint (X) (%) | 29 | 30 | 32 | 33 | 29 | 32 |
| Film thickness 60 seconds after the application of aqueous base paint (X) (μm) | 31 | 29 | 29 | 27 | 19 | 18 |
| Effect pigment dispersion (Y) | Y-1 | Y-1 | Y-1 | Y-1 | Y-1 | Y-1 |
| Clear paint (Z) | Z-1 | Z-1 | Z-1 | Z-1 | Z-1 | Z-1 |
| 60-degree specular gloss (60 degree gloss) | 131 | 132 | 130 | 131 | 132 | 132 |
| Finished appearance: Smoothness | Pass | Pass | Pass | Pass | Pass | Pass |
| Finished appearance: Sag | Pass | Pass | Pass | Pass | Pass | Pass |
| Finished appearance: Unevenness | Pass | Pass | Pass | Pass | Pass | Pass |

| | Comparative Example | | | |
|---|---|---|---|---|
| | 1 | 2 | 3 | 4 |
| Solvent-based intermediate paint (V) | V-1 | V-1 | V-1 | V-1 |
| Solvent-based intermediate paint (W) | W-1 | W-1 | W-1 | W-1 |
| Aqueous base paint (X) | X-2 | X-6 | X-6 | X-5 |
| Paint discharge amount in the application of aqueous base paint (X) (cm$^3$/min) | 137 | 273 | 205 | 314 |
| Shaping air pressure in the application of aqueous base paint (X) (MPa) | 0.2 | 0.2 | 0.2 | 0.2 |
| Viscosity 60 seconds after the application of aqueous base paint (X) (Pa · s) | 194 | 36 | 52 | 40 |
| Solids content 60 seconds after the application of aqueous base paint (X) (%) | 33 | 27 | 31 | 24 |
| Film thickness 60 seconds after the application of aqueous base paint (X) (μm) | 18 | 44 | 35 | 51 |
| Effect pigment dispersion (Y) | Y-1 | Y-1 | Y-1 | Y-1 |
| Clear paint (Z) | Z-1 | Z-1 | Z-1 | Z-1 |
| 60-degree specular gloss (60 degree gloss) | 130 | 126 | 127 | 125 |
| Finished appearance: Smoothness | Fail | Fail | Fail | Pass |
| Finished appearance: Sag | Pass | Pass | Pass | Fail |
| Finished appearance: Unevenness | Pass | Fail | Fail | Pass |

The invention claimed is:

1. A method for forming a multilayer coating film, comprising in sequence:

step (1): applying a solvent-based intermediate paint (V) to a substrate to form an uncured first intermediate coating film;

step (2): heating the uncured first intermediate coating film to cure the coating film;

step (3): applying a solvent-based intermediate paint (W) to the cured first intermediate coating film to form an uncured second intermediate coating film;

step (4): heating the uncured second intermediate coating film to cure the coating film;

step (5): applying an aqueous base paint (X) to the cured second intermediate coating film to form an uncured base coating film;

step (6): applying an effect pigment dispersion (Y) to the uncured base coating film to form an uncured effect coating film;

step (7): applying a clear paint (Z) to the uncured effect coating film to form an uncured clear coating film; and step (8): heating the uncured base coating film, the uncured effect coating film, and the uncured clear coating film to simultaneously cure the coating films, wherein the aqueous base paint (X) is applied using a rotary-atomization bell-shaped coater under coating conditions of a shaping air pressure of 0.15 to 0.25 MPa and a paint discharge amount of 100 to 300 $cm^3$/min, the viscosity 60 seconds after the application of the aqueous base paint (X), measured at a temperature of 23° C. and a shear rate of 0.1 $sec^{-1}$, is 90 to 160 mPa·s, the solids content 60 seconds after the application is 20 to 40 mass %, and the film thickness 60 seconds after the application is 17 to 35 μm, wherein the effect pigment dispersion (Y) contains a flake-aluminum pigment (A) with an average thickness of 1 nm or more and less than 70 nm, a flake-aluminum pigment (B) with an average thickness of 70 nm to 250 nm, a hydroxy-containing acrylic resin (C), a rheology control agent (D), a surface-adjusting agent (E), and water, the effect pigment dispersion (Y) having a solids content of 2 to 9 mass %, and wherein the effect coating film after curing has a film thickness of 0.5 to 2.0 μm.

2. The method for forming a multilayer coating film according to claim 1, wherein the flake-aluminum pigment (A) with an average thickness of 1 nm or more and less than 70 nm includes vapor deposition aluminum flake pigment and the flake-aluminum pigment (B) with an average thickness of 70 nm to 250 nm includes aluminum flake pigment.

* * * * *